US006971496B1

(12) United States Patent
Nurnberg et al.

(10) Patent No.: US 6,971,496 B1
(45) Date of Patent: Dec. 6, 2005

(54) ESCALATOR BRAKING WITH MULTIPLE DECELERATION RATES

(75) Inventors: Thomas Nurnberg, Port Byron, IL (US); Yilmaz Ozgur Cantez, East Moline, IL (US)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/886,726

(22) Filed: Jul. 9, 2004

(51) Int. Cl.[7] ..... B66B 15/00
(52) U.S. Cl. ..... 198/323; 198/330
(58) Field of Search ..... 198/322, 323

(56) References Cited

U.S. PATENT DOCUMENTS 4,588,065 A * 5/1986 Maiden et al. ..... 198/323
4,664,247 A * 5/1987 Wolf et al. ..... 198/323
4,926,981 A * 5/1990 Bruehl et al. ..... 198/323
6,247,575 B1 * 6/2001 Thiel ..... 198/330
6,267,219 B1 * 7/2001 Spannhake et al. ..... 198/323
6,273,234 B1 * 8/2001 Balzer-Apke et al. ..... 198/323
6,520,300 B2 * 2/2003 Balzer-Apke et al. ..... 198/323

* cited by examiner

*Primary Examiner*—James R. Bidwell
(74) *Attorney, Agent, or Firm*—Birch, Stewart, Kolasch & Birch, LLP

(57) ABSTRACT

A braking system for an escalator having multiple rates of deceleration. When electrical protective devices (EPD) indicate that the escalator should be stopped, the main controller makes a determination as to whether the maximum rate of deceleration should be applied or the lower rate of deceleration. The brake is then controlled according to this determination to prevent a sudden stopping of the escalator when it is not necessary. The EPDs may be divided into two or more groups for different rates of deceleration. A provision may be made for multiple signals at once. If the main controller fails to provide a deceleration rate, the braking controller automatically defaults to the maximum rate. This system may also be used with moving walkways or other conveyors.

19 Claims, 2 Drawing Sheets

ESCALATOR BRAKING WITH MULTIPLE DECELERATION RATES

BACKGROUND OF THE INVENTION

1. Field of the Invention

The present invention relates generally to a braking system for an escalator and more particularly to an escalator emergency braking system having different rates of deceleration depending on the specific malfunction encountered.

2. Description of the Background

Escalators are well known as a safe and efficient means of moving people between floors in buildings and other public facilities. In order to safely protect their passengers and also to protect the equipment, a number of sensors are placed in the equipment to determine any malfunctions that may occur. These sensors are used to provide an indication to a controller that the escalator should make an emergency stop.

The controller provides an indication to the braking system that the escalator should come to an emergency stop when a sensor is tripped. However, current systems either stop the escalator at a deceleration rate that varies inversely with the load on the escalator, or stop at a fixed rate regardless of the load on the escalator. This deceleration rate range is defined by building codes and often results in a more sudden and uncomfortable stop than necessary when the escalator is lightly loaded, or a longer than desirable stop when a serious equipment malfunction occurs with a heavily loaded escalator.

SUMMARY OF THE INVENTION

Accordingly, the present invention provides a braking system for an escalator having more than one rate of deceleration defined.

Further, the present invention provides an emergency braking system having two deceleration rates defined.

The present invention further provides a braking system for an escalator where the specific rate of deceleration depends on the specific malfunction sensed.

The present invention still further provides an emergency braking system with a deceleration rate based on the status of electrical protective devices (EPDs).

The present invention still further provides a braking system for an escalator where the determination of the rate of deceleration also depends on the direction of travel.

The present invention also provides a method for braking an escalator at different rates of deceleration.

Briefly, this is achieved by providing an escalator system having a series of electrical protective devices which sense the operation of the escalator. When one of the sensors sends a signal to the escalator controller, a determination is made as to the rate of deceleration which is then sent to the braking controller for stopping the escalator.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
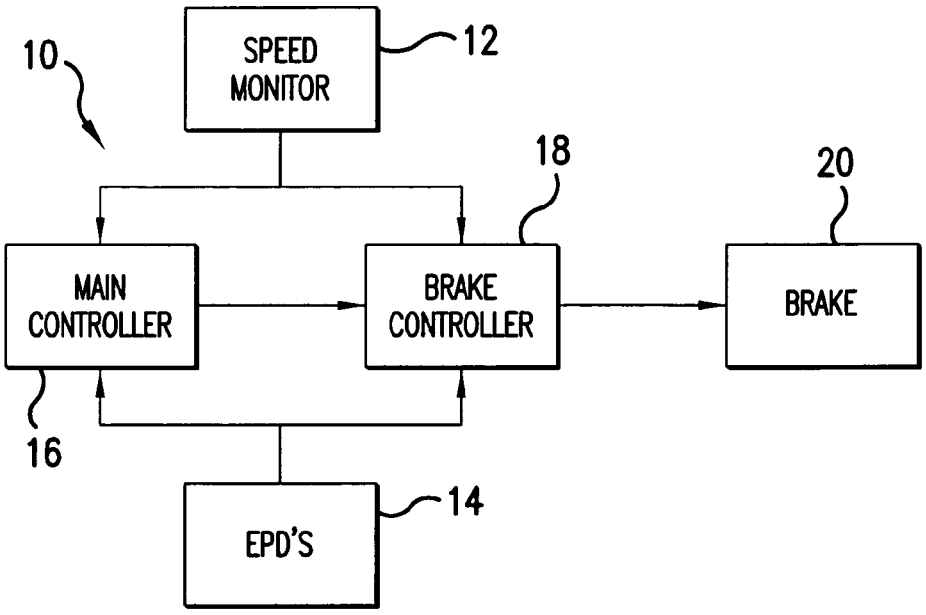
FIG. 1 is a block diagram of the escalator braking system according to the present invention.

FIG. 1 shows a block diagram of the braking system 10 for an escalator. According to this system, a speed monitor 12 provides an indication of the speed of the escalator, as well as its direction of travel.

The system also includes electrical protective devices 14 which are sensors providing signals concerning improper operation of the device. Some of these sensors relate to difficulties in the machinery itself, while others provide indications of a safety malfunction. Manually operated emergency stop buttons are also included.

A main controller 16 provides for the overall operation of the escalator, including the braking procedures. The main controller provides a signal to braking controller 18 for indicating that emergency braking should occur and also for the rate of deceleration that is desired. The braking controller applies a signal to brake 20, causing the actual braking of the escalator.

Both the speed monitor 12 and the EPDs 14 provide signals to both the main controller and the braking controller so that both controllers are aware of the speed of operation and also the presence of any sensor signals. This enables them to efficiently manage the operation of the escalator.

Building codes provide for a maximum rate of deceleration for an escalator, in order to prevent injury to the passengers. That is, if an escalator is stopped too suddenly, it is likely to cause passengers to lose their balance and be thrown onto the escalator steps. However, it is generally desirable to stop the escalator as soon as possible to prevent injury to the passengers when an equipment malfunction occurs.

In the past, systems have stopped the escalators at the same rate, or at a rate that varies with escalator load, no matter which sensor was tripped. This rate of deceleration was generally a fast rate, since it is imperative that the escalator be stopped quickly if the problem is one that can cause injury if left unstopped. For example, if the emergency stop button is pressed, it is imperative that the escalator be stopped as quickly as allowed by code. However, if some other problem is detected, such as a signal from a smoke detector, it may not be imperative to stop the escalator quite as quickly. The prior art devices have not distinguished between these two different types of signals.

Since stopping the escalator at the maximum deceleration rate can be uncomfortable and possibly dangerous for some rider behavior, it would be preferable to apply a slower deceleration rate when the situation allows it. It should also be remembered that for some problems it may be possible to use a slower rate of deceleration in one direction than the other. For example, the EPD that indicates that the step is not level may require a fast stop if the escalator step is moving toward the landing, but a slower stop if the escalator step is moving away from the landing.

When speaking of deceleration rates, a fast deceleration would be on the order of three feet/second/second. A slower deceleration rate would be on the order of one foot/second/second or perhaps as low as one-half feet/second/second.

The escalator system will normally have a number of different electrical protective devices or sensors. Among those that require a fast stop rate are the emergency stop buttons, the broken step chain sensor, the skirt obstruction sensor, and the comb impact sensor. These sensors all require a fast stop rate since continued operation of the escalator could provide injury to a passenger. Sensors for which a slower stop rate is appropriate include a speed governor, a step up thrust sensor, a hand rail entry sensor, a hand rail speed monitor sensor, a missing step sensor, an escalator smoke detector, a reversal stop device, an escalator egress restriction sensor, and a tandem operation sensor. These sensors, while indicating important safety concerns, are not so imperative as to require the maximum rate of deceleration.

Still other devices, such as a step level sensor, require a fast deceleration rate when the escalator step is moving toward the landing, but does not require the fast deceleration rate while the escalator step is moving away from the landing. While the specific sensors and the number of sensors may vary from system to system, it will always be possible to divide the sensors into groupings of those that require a high deceleration and those which require a lesser deceleration. It is also possible to use more than two groupings if additional deceleration rates are desirable.

The system operates under the direction of the main controller 16. The main controller receives signals from the speed monitor to indicate the speed and direction of the escalator. The EPDs also send a signal, or a lack of a signal, to indicate their condition. When one of the sensors is tripped, a signal is sent to both the main controller and the braking controller. When the main controller receives this signal, it makes a determination as to whether the sensor is one that requires a maximum deceleration rate or a slower deceleration rate. This determination can be made by using a look-up table. It could also be determined using a series of logic gates or may be determined by a software arrangement. Any number of other standard operations can be used to make this determination.

Once the determination is made, the main controller provides a signal to the braking controller to indicate the rate of deceleration. The braking controller then controls the brake itself in a known manner, so that the escalator is decelerated at the desired rate. The braking controller also receives indications from the speed monitor as to the speed of the escalator, so that the deceleration rate can be monitored and adjusted as necessary.

The braking controller also receives a signal from the EPD sensors 14. This is to let the braking controller know that a braking event has occurred and that a deceleration rate should be expected from the main controller. If for any reason the main controller does not properly provide an indication of the desired deceleration rate, the braking controller then can default to the higher deceleration rate. This failsafe method prevents the possibility that the braking controller continues to wait for an indication of which rate is appropriate.

It is also possible that more than one of the sensors will be tripped at the same time. The decision process in the main controller may take into account that more than one sensor has provided a signal at the same time. Thus, even if all of the tripped sensors would normally provide a slower deceleration rate if activated singly, it is possible that the main controller may issue a faster deceleration rate signal, since multiple sensors have been activated at the same time. Of course, it would be possible to have a fast rate for some combinations and a slow rate for other combinations.

Figure 2:
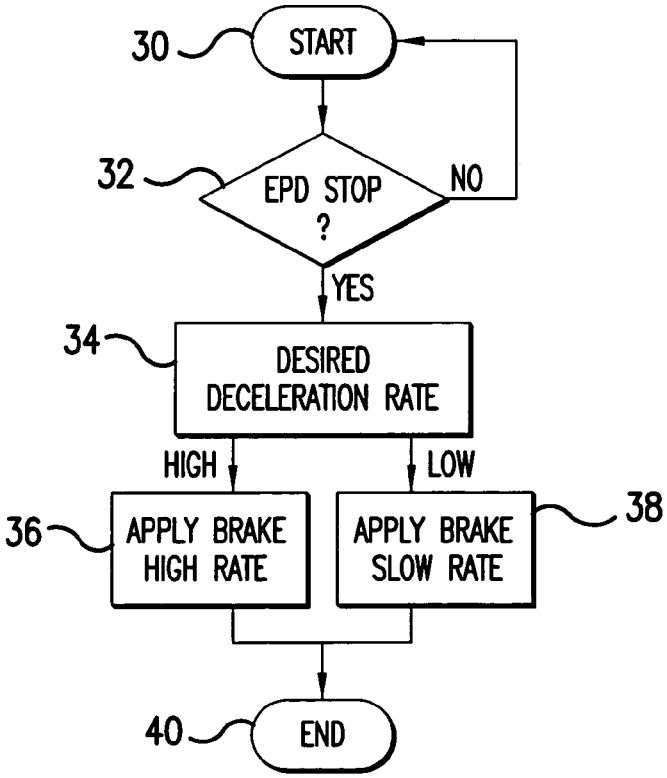
FIG. 2 is a flow chart showing the method of operation of the braking system of the present invention.

FIG. 2 shows the general method of operation of the system. In step 30, the method starts with the escalator running in normal fashion. The EPDs are interrogated or otherwise sensed in step 32 to see if any of the sensors have been tripped. If not, the system returns to the starting point. However, when a signal is received from an EPD, the desired deceleration rate is determined in step 34. If a high deceleration rate is desired, a signal is sent in step 36 to the brake controller to utilize a high rate of deceleration. Likewise, if it is determined that a lower rate of deceleration is preferred, a signal is sent in step 38 to the braking controller. Once the brakes have been applied and the escalator comes to a stop, the process stops at step 40.

Figure 3:
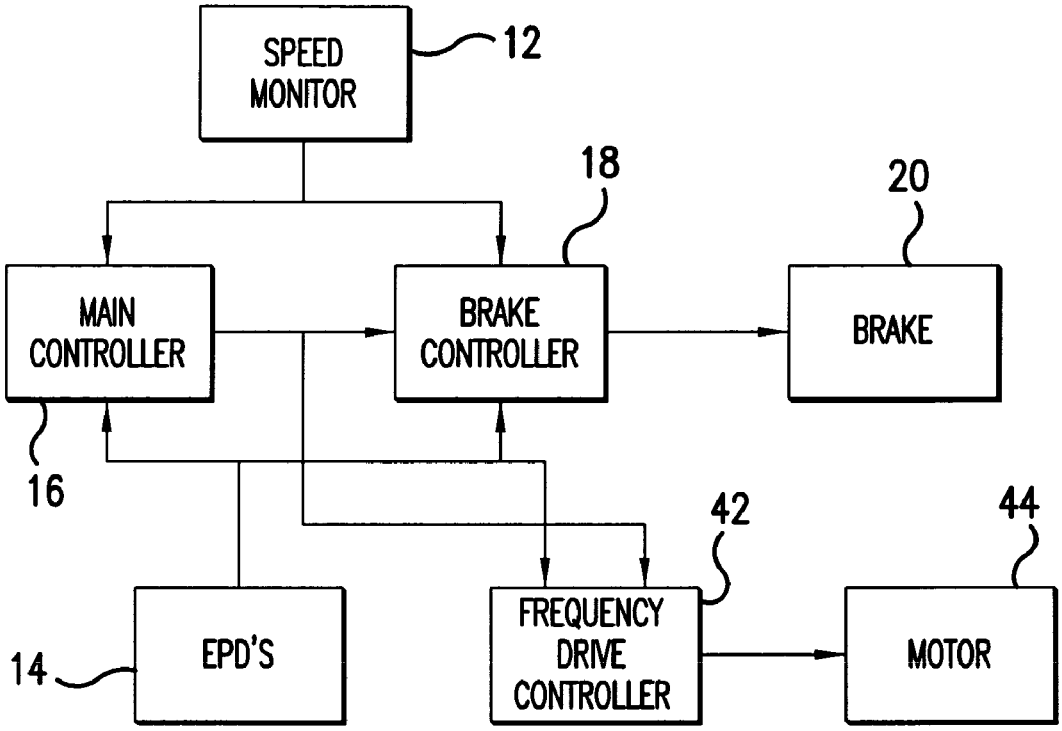
FIG. 3 is a block diagram of the escalator braking system according to a second embodiment of the present invention.

FIG. 3 shows a second embodiment of the present invention. In this system, the sensors, main controller, brake controller, speed monitor and brake operate in the same fashion as in FIG. 1. However, in addition, a frequency drive controller 42 has been added, which provides a speed control signal to the escalator driving motor 44. In this fashion, the motor is also driven in parallel with the application of the brake to control the deceleration rate of the escalator.

The frequency drive controller receives inputs from the EPDs 14 at the same time the signals are applied to the main controller and the brake controller. The frequency drive controller also receives a signal from the main controller, which is the same as the signal applied to the brake controller which indicates the value of deceleration which is desired. Based on these signals, the drive controller provides a signal to the motor so that the motor is controlled to the proper deceleration rate at the same time.

While the above system and method have been described in terms of an escalator, it is also possible to use a similar system for other devices, such as power walks, moving walkways, conveyors or ramps. It is also possible to use the basic principles of this system in other devices, such as elevators, or any system which utilizes a series of safety sensors.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A braking apparatus comprising:

a controller, including a main controller and a brake controller, said main controller providing a signal indicating a rate of acceleration to the brake controller and the brake controller producing a braking signal;

a brake connected to said controller for receiving said braking signal and applying braking to a mechanism; and a plurality of sensors connected to said controller for indicating malfunctions;

said braking signal selectively causing braking at one of a plurality of deceleration rates.

2. The braking system according to claim 1, wherein the deceleration rate is determined by the controller according to the sensors indicating malfunctions.

3. The braking system according to claim 2, wherein the rate of deceleration is further determined by the number of sensors indicating malfunctions.

4. The braking system according to claim 2, wherein the rate of deceleration is determined according to the sensor indicating the malfunction and the direction of movement of the mechanism.

5. The braking system according to claim 1, wherein the mechanism is an escalator system.

6. The braking system according to claim 1, further comprising a speed monitor for providing signals indicating the speed of the mechanism to the controller.

7. The braking system according to claim 1, wherein one rate of deceleration is two feet/second/second and a second rate of deceleration is one foot/second/second.

8. The braking system according to claim 1, wherein said brake controller defaults to a maximum rate of deceleration if no rate is indicated from the main controller.

9. The braking system according to claim 1, further comprising a frequency drive controller connected to said plurality of sensors and said controller for generating a driving motor signals.

10. The braking system according to claim 9, wherein the driving motor signal drives a driving motor at an appropriate deceleration rate in parallel with the application of braking.

11. A method of braking, comprising:

determining whether at least one of a plurality of sensors indicates a malfunction;

determining a desired deceleration rate based on which sensors are indicating malfunctions; and applying brakes according to the selected deceleration rate; wherein the deceleration rate is determined according to the sensors indicating malfunctions and the number of sensors providing malfunction indications.

12. The method according to claim 11, wherein the brakes are applied in an escalator system.

13. The method according to claim 11, wherein the rate of deceleration is determined according to the sensors indicating malfunctions and the direction of travel.

14. The method according to claim 11, further comprising defaulting to a maximum deceleration rate if a determined deceleration rate is not provided.

15. The method according to claim 11, further comprising a step of controlling a motor to be driven at the selected deceleration rate in parallel with the application of the brakes.

16. The braking system according to claim 1, wherein the mechanism is a moving walkway.

17. The braking system according to claim 1, wherein the mechanism is a conveyor.

18. The method according to claim 11, wherein the brakes are applied in a moving walkway.

19. The method according to claim 11, wherein the brakes are applied in a conveyor.

* * * * *